US011898320B2

(12) United States Patent
Vahling

(10) Patent No.: US 11,898,320 B2
(45) Date of Patent: Feb. 13, 2024

(54) CIRCLE DRIVE SYSTEM FOR A GRADING MACHINE

(71) Applicant: Caterpillar Inc., Peoria, IL (US)

(72) Inventor: Bruce R. Vahling, Urbana, IL (US)

(73) Assignee: Caterpillar Inc., Peoria, IL (US)

( * ) Notice: Subject to any disclaimer, the term of this patent is extended or adjusted under 35 U.S.C. 154(b) by 709 days.

(21) Appl. No.: 16/664,090

(22) Filed: Oct. 25, 2019

(65) Prior Publication Data

US 2021/0123208 A1 Apr. 29, 2021

(51) Int. Cl.

| | |
|---|---|
| ***E02F 3/76*** | (2006.01) |
| ***E02F 3/84*** | (2006.01) |
| ***E02F 9/22*** | (2006.01) |

(52) U.S. Cl.

CPC ..... *E02F 3/844* (2013.01); *E02F 3/764* (2013.01); *E02F 3/7636* (2013.01); *E02F 9/2203* (2013.01)

(58) Field of Classification Search

CPC . E02F 3/7636; E02F 3/764; E02F 3/84; E02F 3/844; E02F 9/2079; E02F 9/2203

See application file for complete search history.

(56) References Cited

U.S. PATENT DOCUMENTS

| | | | | |
|---|---|---|---|---|
| 3,819,018 | A | 6/1974 | Muller et al. | |
| 3,989,112 | A | 11/1976 | Cole et al. | |
| 4,122,903 | A | 10/1978 | Cole | |
| 9,540,787 | B2 | 1/2017 | West et al. | |
| 9,644,341 | B2 * | 5/2017 | Yoshimura | E02F 3/7645 |
| 10,745,885 | B2 * | 8/2020 | Stoops | F15B 13/027 |
| 11,585,411 | B2 * | 2/2023 | Smemo | E02F 3/7645 |
| 2019/0085528 | A1 | 3/2019 | Ono | |
| 2020/0370276 | A1 * | 11/2020 | Harshman | E02F 3/764 |

* cited by examiner

*Primary Examiner* — Gary S Hartmann

(57) ABSTRACT

A grading machine includes a machine body, a grading blade supported by a circle, a drawbar connecting the grading blade and the circle to the machine body, and a circle drive system. The circle drive system includes a circle drive motor with a motor shaft, a gear box, a gear coupling, and a braking mechanism. The gear box is configured to engage with and rotate the circle relative to the drawbar around a circle axis. The braking mechanism is positioned between the circle drive motor and the gear coupling and is configured to selectively engage the motor shaft.

20 Claims, 3 Drawing Sheets

CIRCLE DRIVE SYSTEM FOR A GRADING MACHINE

TECHNICAL FIELD

The present disclosure relates generally to a grading machine, and more particularly, to a circle drive system for a grading machine.

BACKGROUND

The present disclosure relates to mobile machines that are used in grading. Grading machines, such as motor graders, are typically used to cut, spread, or level material that forms a ground surface. To perform such earth sculpting tasks, grading machines include a blade, also referred to as a moldboard or implement. The blade moves relatively small quantities of earth from side to side, in comparison to a bulldozer or other machine that moves larger quantities of earth. Grading machines are frequently used to form a variety of final earth arrangements, which often require the blade to be positioned in different positions and/or orientations depending on the sculpting task and/or the material being sculpted. A circle drive may control a position of a circle coupled to the blade, and thus adjust a blade cutting angle. Different earth sculpting tasks and different ground surface materials may impart different amounts of force on the blade and different amounts of torque on the circle drive when the blade is engaged with material, which may affect the positioning of the blade and circle, or may damage the circle drive.

U.S. Pat. No. 9,520,787, issued to West et al. on Jan. 10, 2017 ("the '787 patent"), describes an apparatus for positioning a circle and a moldboard relative to a frame of a grading machine. The '787 patent includes a circle drive to control the circle and the moldboard, and the circle drive is coupled to a gear apparatus with an output shaft configured to mesh with and rotate the circle relative to the machine frame. The gear apparatus in the '787 patent may help to increase the torque on the output shaft that rotates the circle relative the frame. However, the system of the '787 patent may interfere with other components of the grading machine, may not securely position the blade and circle when the blade is engaged with material, and/or may impart potentially harmful forces or torques on the circle drive. The system for a grading machine of the present disclosure may solve one or more of the problems set forth above and/or other problems in the art. The scope of the current disclosure, however, is defined by the attached claims, and not by the ability to solve any specific problem.

SUMMARY

In one aspect, a grading machine may include a machine body, a grading blade supported by a circle, a drawbar connecting the grading blade and the circle to the machine body, and a circle drive system. The circle drive system may include a circle drive motor with a motor shaft, a gear box, a gear coupling, and a braking mechanism. The gear box may be configured to engage with and rotate the circle relative to the drawbar around a circle axis. The braking mechanism may be positioned between the circle drive motor and the gear coupling and may be configured to selectively engage the motor shaft.

In another aspect, a circle drive system for a grading machine may include a circle drive motor, a gear box configured to engage with and rotate a circle, a gear coupling including a worm and a worm gear coupling the circle drive motor to the gear box, and a braking mechanism. The braking mechanism may be positioned between the circle drive motor and the worm of the gear coupling.

In yet another aspect, a blade positioning system for a grading machine may include a circle coupled to a grading blade and a circle drive system. The circle may be rotatable around a circle axis. The circle drive system may include a circle drive motor including a motor shaft and having a motor axis, and a gear coupling coupled to the circle drive motor and including a worm and a worm gear. The worm may include a worm axis parallel to the motor axis. The circle drive system may also include a gear box and a braking mechanism. The gear box may be driven by the circle drive motor and the gear coupling. The gear box may include a gear axis parallel to the circle axis, and the gear box may be configured to engage with and drive a rotation of the circle. The braking mechanism may be configured to selectively lock the motor shaft from rotating.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces or materials that may be worked in material moving procedures (e.g., gravel, clay, sand, dirt, etc.) and/or can be cut, spread, sculpted, smoothed, leveled, graded, or otherwise treated. In this disclosure, unless stated otherwise, relative terms, such as, for example, "about," "substantially," and "approximately" are used to indicate a possible variation of ±10% in the stated value.

Figure 1:
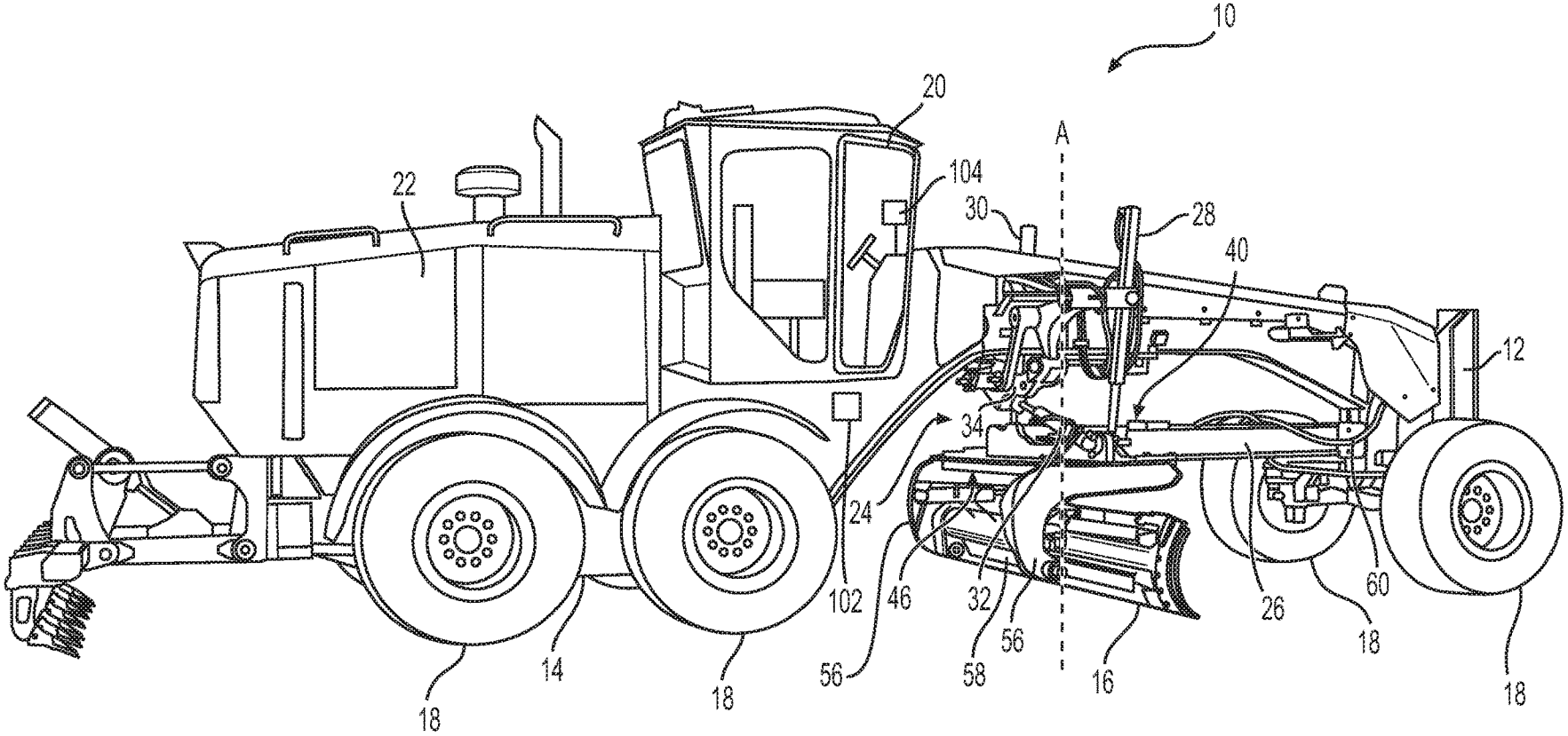
FIG. 1 is an illustration of an exemplary grading machine, according to aspects of this disclosure.

FIG. 1 illustrates a perspective view of an exemplary motor grader machine 10 (hereinafter "motor grader"), according to the present disclosure. Motor grader 10 includes a front frame 12, a rear frame 14, and a blade 16. Front frame 12 and rear frame 14 are supported by wheels 18. An operator cab 20 may be mounted above a coupling of front frame 12 and rear frame 14, and may include various controls, display units, touch screens, or user interfaces, for example, user interface 104, to operate or monitor the status of the motor grader 10. Rear frame 14 also includes an engine 22 to drive and/or power motor grader 10. Blade 16 is used to cut, spread, or level (collectively "sculpt") earth or other material traversed by motor grader 10.

Figure 2:
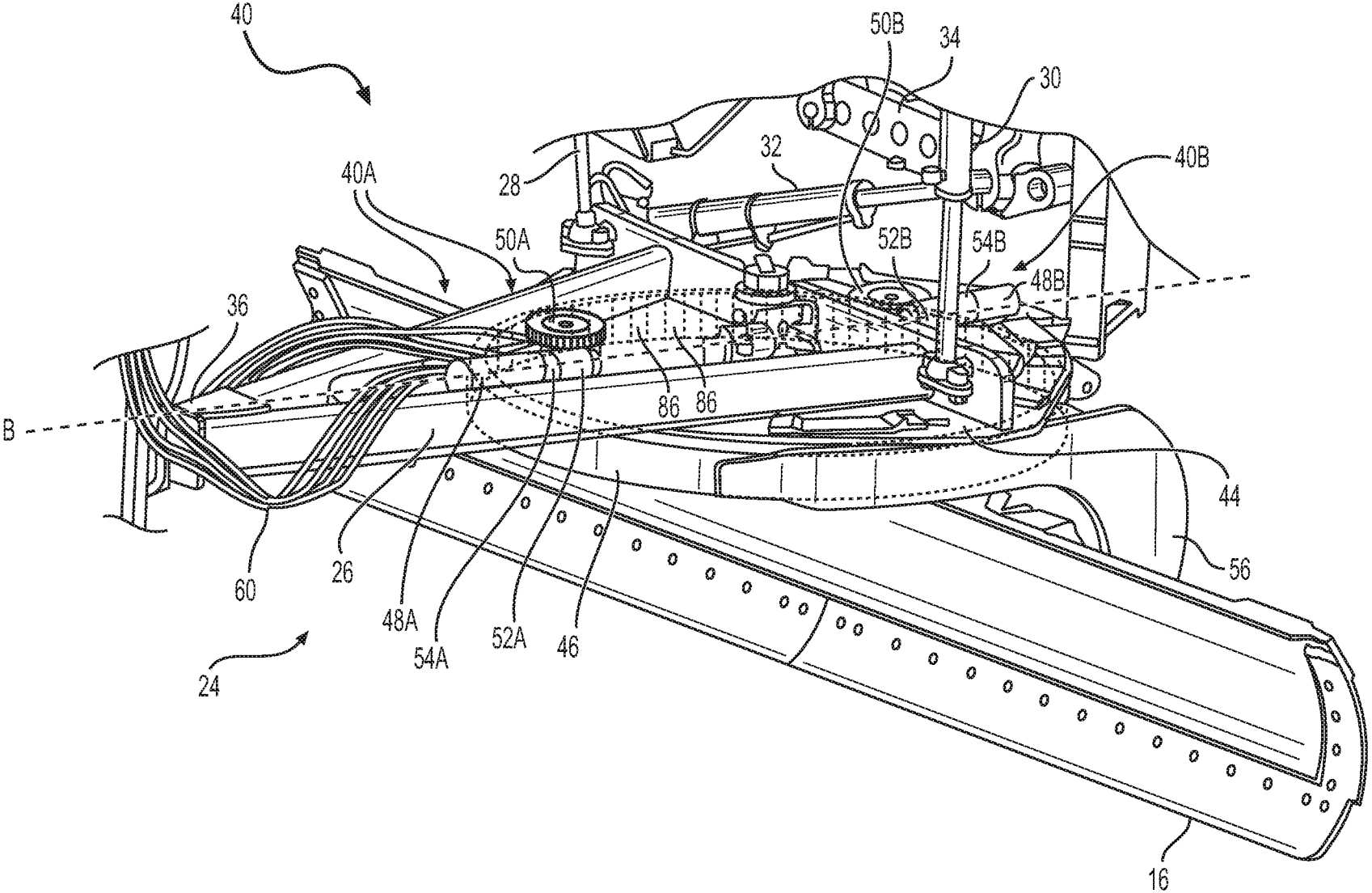
FIG. 2 is a perspective view of the grading portion of the grading machine of FIG. 1.
Figure 3:
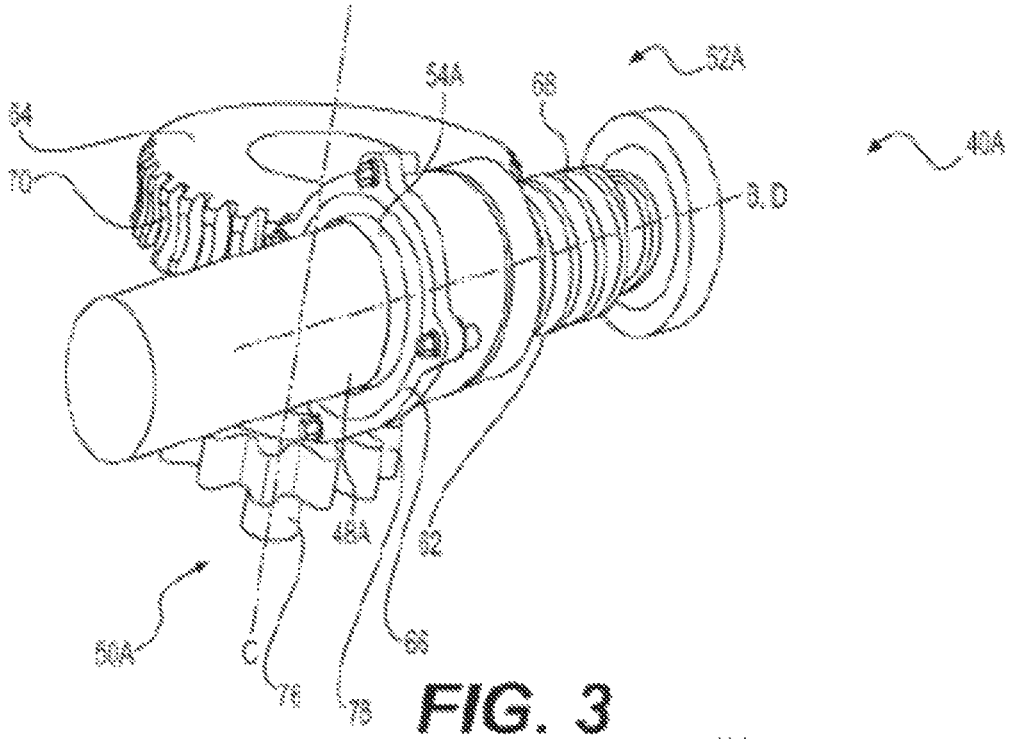
FIG. 3 is a partially exploded view of a portion of a circle drive system of the exemplary grading machine of FIG. 1.
Figure 4:
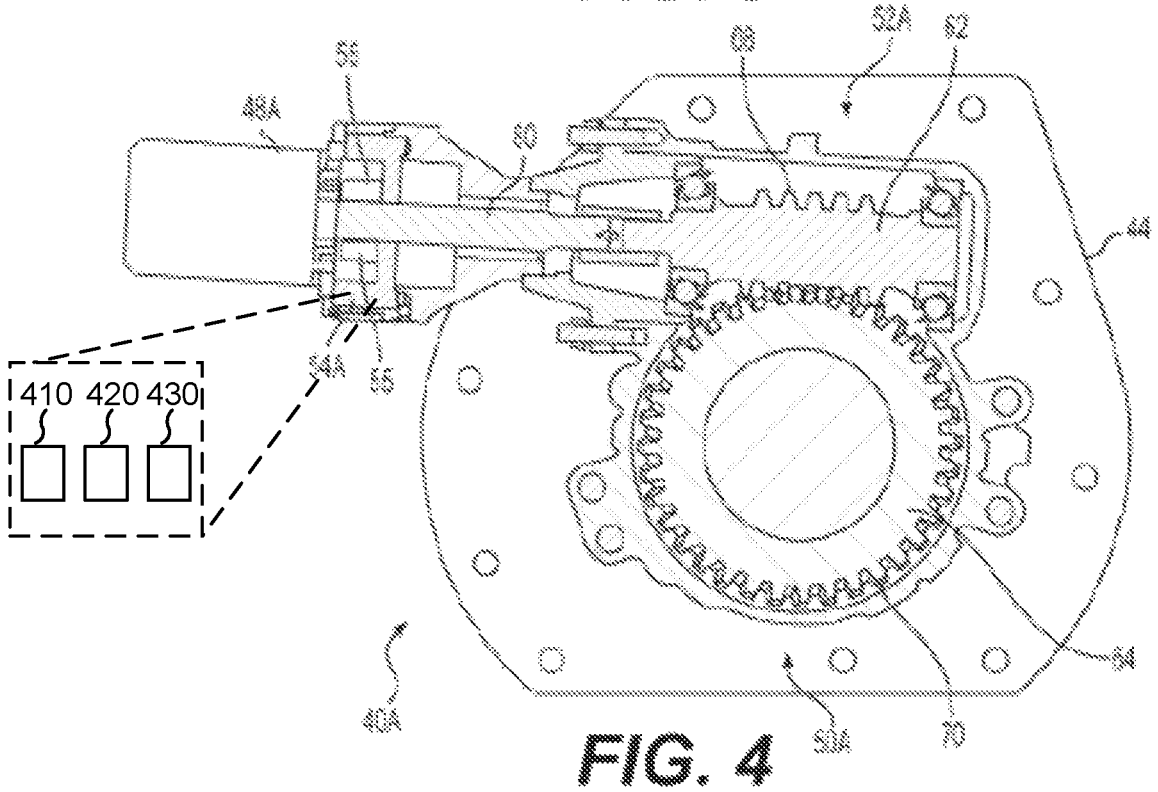
FIG. 4 is a cross-sectional view of a portion of the circle drive system of FIG. 3.

As shown in greater detail in FIG. 2, blade 16 is mounted on a linkage assembly, shown generally at 24. Linkage assembly 24 allows blade 16 to be moved to a variety of different positions and orientations relative to motor grader 10, and thus sculpt the traversed ground surface in different ways. A circle drive system 40 may include or be coupled to a motor, and circle drive system 40 may include a gearing arrangement in order to engage with and rotate a circle 46 (FIGS. 1 and 2) in order to adjust at least one aspect of blade 16. Additionally, as shown in FIGS. 2-4, circle drive system 40 may include one or more braking mechanisms 54A, 54B (hereinafter "brakes") positioned between a drive motor and other portions of circle drive system 40.

Referring back to FIG. 1, a controller 102 may be in communication with one or more features of motor grader 10 and receive inputs from and send outputs to, for example, user interface 104 in cab 20 or an interface remote from motor grader 10. In one aspect, motor grader 10 may be an electrohydraulic motor grader, and controller 102 may control one or more electrical switches or valves in order to control one or more hydraulic cylinders, electrical elements, etc. in order to operate motor grader 10. For example, controller 102 may control one or more switches or valves to control the circle drive system 40 to position blade 16, to engage or release brakes 54A, 54B, etc.

Starting at the front of the grading machine 10 and working rearward toward the blade assembly 16, linkage assembly 24 includes drawbar 26. Drawbar 26 is pivotably mounted to the front frame 12 with a ball joint 36 (FIG. 2). The position of drawbar 26 may be controlled by hydraulic cylinders, including, for example, a right lift cylinder 28, a left lift cylinder 30, a centershift cylinder 32, and a linkbar 34. A height of blade assembly 16 with respect to the surface being traversed below grading machine 10 may be primarily controlled and/or adjusted with right lift cylinder 28 and left lift cylinder 30. Right lift cylinder 28 and left lift cylinder 30 may be controlled independently and, thus, may be used to tilt blade assembly 16. Right lift cylinder 28 and left lift cylinder 30 may also be used (e.g., extended or retracted simultaneously) to control the height of blade assembly 16 relative to grading machine 10 in order to control a depth of the cut into the ground surface or a height of blade assembly 16 above the ground surface. Centershift cylinder 32 and linkbar 34 may be used primarily to shift a lateral position of drawbar 26, and any components mounted to drawbar 26, relative to front frame 12.

As shown in FIG. 2, drawbar 26 is coupled to a large, flat plate, commonly referred to as a yoke plate 44. Beneath yoke plate 44 is a large gear, commonly referred to as a circle 46. Circle 46 is rotatably coupled to yoke plate 44. For example, although not shown, circle 46 may be coupled to yoke plate 44 via a shoe or casting, which may be bolted to the bottom of drawbar and surrounding circle 46. One or more wear strips or bearings may be positioned between circle 46, yoke plate 44, and/or the shoe or casting to help circle 46 rotate relative to yoke plate 44. Circle 46 includes a plurality of teeth 86 that extend along an inner face of circle 46. It is noted that FIG. 2 shows teeth 86 only on a portion of circle 46, but teeth 86 may extend along the entirety of the inner face of circle 46. Circle 46 and blade 16 may be coupled via support arms 56 and a support plate 58 (FIG. 1).

Circle 46 may be rotated by circle drive system 40. In one aspect, as shown in FIG. 2, circle drive system 40 may include a front circle drive system 40A and a rear circle drive system 40B. Front circle drive system 40A and rear circle drive system 40B may be positioned at a front and a rear of yoke plate 44 and drive front and rear portions of circle 46, respectively. Front circle drive system 40A and rear circle drive system 40B may be longitudinally spaced apart and may both be aligned with a drawbar centerline. Front circle drive system 40A may include a front circle drive motor 48A, a front gear box 50A, and a front gear coupling 52A, which may couple circle drive motor 48A to gear box 50A. Rear circle drive system 40B may include a rear circle drive motor 48B, a rear gear box 50B, and a rear gear coupling 52B, which may couple circle drive motor 48B to gear box 50B. Both front circle drive system 40A and rear circle drive system 40B may include one or more brakes 54A, 54B. For example, brake 54A may be positioned between circle drive motor 48A and gear coupling 52A in front circle drive system 40A, and brake 54B may be positioned between circle drive motor 48B and gear coupling 52B in rear circle drive system 40B.

Although not shown, circle drive system 40 may include two front circle drive systems or two rear circle drive systems. In either aspect, the circle drive systems may be laterally spaced apart, for example, positioned on a left and a right side of the drawbar centerline. Alternatively, circle drive system 40 may include a single circle drive system with a single circle drive motor and a single gear box, or more than two circle drive systems, each with a circle drive motor and a gear box.

As shown in FIGS. 1 and 2, motor grader 10 may include a plurality of hydraulic lines 60 in order to control the hydraulic cylinders and/or hydraulic motors. Motor grader 10 may include a hydraulic pump (not shown). The hydraulic pump may supply high pressure hydraulic fluid through one or more of hydraulic lines 60 to one or more of the hydraulic cylinders. A low pilot pressure may be provided by a hydraulic pressure reducing valve, which can receive the high pressure hydraulic fluid and supply low pilot pressure to each hydraulic cylinder. The high pressure hydraulic fluid and the low pilot pressure may be selectively supplied to hydraulic actuators to control the hydraulic cylinders and/or hydraulic motors. Additionally, each hydraulic cylinder may include an electrical solenoid and one or more hydraulic valves. The solenoid may receive one or more signals from controller 102 to control and position each hydraulic cylinder by configuring the flow of hydraulic fluid through the valves. The delivery of the hydraulic fluid may be controlled by controller 102, for example, via one or more user interfaces 104. In one aspect, controller 102 controls the delivery of hydraulic fluid through hydraulic lines 60 to circle drive motors 48A, 48B to control the position of circle 46 and blade 16 and/or to brakes 54A, 54B to selectively engage brakes 54A, 54B.

As shown in FIG. 2, circle drive motors 48A, 48B may be hydraulic motors coupled to one or more hydraulic lines 60, and may be in communication with controller 102 and/or user interface 104. Alternatively, circle drive motors 48A, 48B may be electric motors or any other appropriate type of motor. Circle drive motors 48A, 48B may be any motor that includes or is coupled to a rotational output shaft (e.g., motor shaft 80 in FIG. 4), for example, a gear motor, a vane motor, an axial plunger motor, a radial piston motor, etc. Based on the effect of circle drive systems 40A, 40B, circle 46 and blade 16 may be rotated clockwise or counterclockwise relative to front frame 12 about axis A. In one aspect, circle 46 and blade 16 may be rotated up to approximately 75 degrees clockwise or counterclockwise about axis A. In another aspect, circle 46 and blade 16 may be rotated 360 degrees clockwise or counterclockwise about axis A.

FIGS. 3 and 4 illustrate portions of front circle drive system 40A. It is noted that the portions of rear circle drive system 40B may be identical to or similar to the portions of front circle drive system 40A shown in FIGS. 3 and 4. Alternatively, rear circle drive system 40B may be smaller (e.g., generate less torque on circle 46 and/or require less space on linkage assembly 24) than front circle drive system 40A.

As mentioned above, circle drive system 40A may include one or more gear couplings 52A connecting circle drive motor 48A (shown smaller in FIGS. 3 and 4 than in FIG. 2 for clarity) and gear box 50A. As shown in FIGS. 2 and 3, circle drive motor 48A may have an axis of rotation B, and gear box 50A may have an axis of rotation C. As shown in FIG. 3, gear box 50A may include a drive shaft 76 and a circle engaging gear 78, and drive shaft 76 and circle engaging gear 78 may rotate around axis C. Axis of rotation C may be parallel to axis A (FIG. 1) of circle 46. The one or more gear couplings 52A may allow for the axis of rotation B for circle drive motor 48A to be substantially perpendicular to axis of rotation C for gear box 50A. Stated another way, the one or more gear couplings 52A may enable a transmission of power from along a first axis to along a second axis that is perpendicular to the first axis. Accordingly, rotation of circle drive motor 48A around motor axis B rotates elements of gear box 50A around axis C, and thus rotates circle 46 and blade 16 around axis A. Gear coupling 52A may include a worm gear arrangement (as shown) to couple gear assemblies having perpendicular axes of rotation.

In the aspect where gear coupling 52 includes a worm gear arrangement, gear coupling 52 includes a worm 62 and a worm gear 64. Worm 62 may be coupled to an output shaft of circle drive motor 48A, for example, via a motor mount 66, or may be coupled to circle drive motor 48A, for example, via motor shaft 80 (FIG. 4). Accordingly, circle drive motor 48 may rotate worm 62 around a worm axis D, and worm axis D may be substantially parallel or coaxial to motor axis B (as shown). Worm 62 may include helical teeth 68 that engage with gears 70 of worm gear 64, such that rotation of worm 62 then rotates worm gear 64. Worm gear 64 may also rotate around axis C of gear box 50A. Worm gear 64 may then be coupled directly or indirectly to one or more portions of gear box 50A, for example, to drive shaft 76 and/or circle engaging gear 78. Although not shown, gear box 50A may include one or more slip clutches, which may help to protect circle drive motor 48A and gear coupling 52A in a situation where blade 16 or circle 46 encounters a heavy or severe external load while sculpting the traversed ground surface.

Gear box 50A may include a combining interface 74. Combining interface 74 may help support and/or separate various portions of gear box 50A and/or may help connect gear coupling 52A to the other portions of gear box 50A. For example, although not shown, combining interface 74 may include an exterior with threaded holes or other coupling mechanisms to couple exterior components of gear coupling 52A to other portions of gear box 50A, and/or to help couple gear box 50A to a portion of yoke plate 44.

Worm gear 64 may be directly coupled to one or more interior portions of gear box 50A. For example, drive shaft 76 may extend from worm gear 64 and may be coupled to circle engaging gear 78. Accordingly, rotation of worm gear 64 rotates drive shaft 76 and circle engaging gear 78. Circle engaging gear 78 may engage with teeth 86 (FIG. 2) on the internal face of circle 46 such that rotation of circle engaging gear 78 rotates circle 46, and thus controls a blade angle of blade 16. Once circle 46 has been rotated to angle blade 16 to the desired blade angle, machine 10 may perform a grading operation.

As mentioned, brake 54A may be positioned between circle drive motor 48A and gear coupling 52A. Brake MA may be configured to lock the movement of circle drive motor 48A and/or motor shaft 80. For example, brake 54A may be positioned between a housing of circle drive motor 48A and motor shaft 80. In one aspect, when engaged, brake 54A may lock the housing of circle drive motor 48A and motor shaft 80 together. One or more portions of circle drive motor 48A and/or motor shaft 80 may include one or more grooves or notches, and brake MA may include one or more locking elements 410, 420, and/or 430 (e.g., ratcheted fingers 410, springs 420, teeth 430, etc.) that may engage with the one or more grooves or notches to secure circle drive motor 48A and/or motor shaft 80 in the locked configuration. Alternatively, brake MA may tighten around and/or clamp on to one or more portions of circle drive motor 48A and/or motor shaft 80 in order to frictionally engage with and secure one or more portions of circle drive motor 48A and/or motor shaft 80. In one aspect, brake MA may be engaged with one or more springs (e.g., spring(s) biased toward the engaged position) in a resting state for circle drive motor 48A. When a circle rotation command is received (e.g., to rotate circle 46 and angle blade 16), brake 54A may be released, for example, via a change in hydraulic pressure disengaging spring(s), allowing circle drive motor 48A to rotate motor shaft 80, and thus rotate circle 46 and angle blade 16. When the circle rotation command is completed, brake 54A may be reapplied. In another aspect, brake MA may be engaged and/or disengaged via a movable lever, an electrical brake, or other appropriate mechanisms.

Furthermore, brake 54A may engage with one or more portions of circle drive motor 48A and/or motor shaft 80 in other ways in order to secure circle drive motor 48A and/or motor shaft 80 in the locked configuration. Brake 54A may be positioned in the locked configuration when blade 16 is positioned at a selected blade angle, such that circle drive motor 48A and/or motor shaft 80 are secured in a locked position and are prevented from rotating. In one aspect, brake 54A may be engaged upon controller 102, user interface 104, etc. receiving instructions or otherwise sensing that a blade positioning operation is complete, that a grading operation is initiated, or another situation in which the position of the blade is fixed or in which imparting forces or torques on circle drive motors 48A, 48B is not desirable.

Brake 54A may be selectively releasable. For example, brake 54A may be controlled by controller 102 and/or user interface 104, as mentioned above. In one aspect, when user interface 104 receives an input to reposition blade 16, controller 102 may signal brake 54A to transition to an unlocked configuration such that circle drive motor 48A may rotate circle 46 to reposition blade 16. Brake 54A may transition from the locked configuration to the unlocked configuration by, for example, transitioning from a clamped configuration and a loosened configuration around motor shaft 80 or otherwise disengaging with one or more portions of circle drive motor 48A and/or motor shaft 80. For example, as shown in FIG. 4, brake 54A may include shaft engaging elements 55 that may engage with one or more portions of motor shaft 80 in the locked configuration. Shaft engaging elements 55 may automatically disengage with motor shaft, for example, when user interface 104 receives an input to reposition blade 16, as discussed above. The transitioning from the unlocked configuration and the locked configuration, and vice versa, may be hydraulically controlled, for example, by hydraulic lines 60 being coupled to brake 54A. Alternatively or additionally, the engagement and disengagement of brake 54A may be manually controlled, for example, via a pedal, lever, etc. positioned in cab 20.

Although the above discussion is directed to brake 54A, it is noted that brake 54B may function similarly in order to lock and unlock one or more portions of circle drive motor 48B and/or its motor shaft.

Furthermore, it is noted that motor grader 10 may include any number of circle drive systems 40, 40A, 40B. Motor grader 10 may include one circle drive system 40, may include two circle drive systems 40A, 40B (FIGS. 1 and 2), or may include more than two circle drive systems. The one or more circle drive systems 40, 40A, 40B may be coupled to various portions of circle 46, and each circle drive system 40, 40A, 40B and components of each circle drive system 40, 40A, 40B may be different sizes. Referring to FIG. 2, front circle drive system 40A may be larger than rear circle drive system 40B. For example, front circle drive motor 48A may be larger than rear circle drive motor 48B, and/or front gear box 50A may be larger than rear gear box 50B. Moreover, although not shown, gear boxes 50A, 50B may include various gear arrangements (e.g., spur gears) in order to increase or decrease the torque delivered to circle 46.

INDUSTRIAL APPLICABILITY

The disclosed aspects of motor grader 10 may be used in any grading or sculpting machine to assist in positioning a blade 16 and/or circle 46. Circle drive systems 40, 40A, 40B, may help an operator position and orient blade 16 and circle 46. During a grading operation, the material being sculpted may impart a large amount of force on blade 16 (e.g., on a lateral end of blade 16), and, correspondingly, impart a large amount of torque on circle drives 40, 40A, 40B. Coupling mechanisms 52A, 52B, including worm 62 and worm gear 64, may include an inherent self-locking feature to help prevent transmission of torques. Additionally, hydraulically driven motors, for example, as circle drive motors 48A, 48B may be, may include an inherent self-braking feature to also help prevent transmission of torques. Nevertheless, the inherent self-locking feature of worm 62 and worm gear 64 and any inherent self-braking feature of circle drive motors 48A, 48B, may not be sufficient to prevent rotation of or otherwise protect circle drive motors 48A, 48B when blade 16 is engaged with the ground surface. For example, forces on blade 16, and resulting torques on circle 46, may impart loads on circle drive systems 40, 40A, 40B, which may cause one or more portions of circle drive systems 40, 40A, 40B to rotate, or may damage one or more portions of circle drive systems 40, 40A, 40B. As mentioned, although not shown, gear boxes 50A, 50B may include one or more slip clutches, which may help to allow slippage between adjacent gears, which may help prevent forces from being imparted to circle drive motors 48A, 48B. In another aspect, gear couplings 52A, 52B may reduce forces being imparted to circle drive motors 48A, 48B, for example, with a larger worm gear set, a high friction oil, etc. Nevertheless, a larger worm gear set may require a larger amount of space and may interfere with the range of motion and/or positioning of blade 16. Moreover, a high friction oil may wear out quickly during grading operations and/or require frequent maintenance or replacement.

The circle drive systems 40, 40A, 40B disclosed herein may address one or more of these potential issues. For example, brakes 54A, 54B may help lock one or more portions of circle drive motors 48A, 48B (e.g., motor shaft 80) and help prevent one or more portions of circle drive motors 48A, 48B from rotating (e.g., by shaft engaging elements 55 engaging with motor shaft 80). As a result, brakes 54A, 54B may help prevent loads on circle drive systems 40, 40A, 40B from affecting circle drive motors 48A, 48B. Brakes 54A, 54B may be respectively positioned between circle drive motors 48A, 48B and gear couplings 52A, 52B, such that any loads may be absorbed and/or distributed within gear couplings 52A, 52B. In one aspect, gear couplings 52A, 54B and/or gear boxes 50A, 50B may be easier and/or less expensive to replace and/or repair than circle drive motors 48A, 48B. As such, brakes 54A, 54B may help to protect circle drive motors 48A, 48B during a grading operation, while also being selectively releasable to allow for adjusting the position of blade 16. In this aspect, brakes 54A, 54B may help to ensure that circle drive motors 48A, 48B do not receive unintended forces, and/or are not driven in an unintended direction (e.g., back-driving motor, which may lead to failure of the motor), etc. Moreover, brakes 54A, 54B may help to retain a blade position and/or orientation, even as blade 16 experiences forces (e.g., help prevent undesired sculpting).

It will be apparent to those skilled in the art that various modifications and variations can be made to the disclosed machine without departing from the scope of the disclosure. Other embodiments of the machine will be apparent to those skilled in the art from consideration of the specification and practice of the circle drive system for a grading machine disclosed herein. It is intended that the specification and examples be considered as exemplary only, with a true scope of the disclosure being indicated by the following claims and their equivalents.

What is claimed is:

1. A grading machine, comprising a machine body;

a grading blade supported by a circle;

a drawbar connecting the grading blade and the circle to the machine body; and a circle drive system including a circle drive motor with a motor shaft, a gear box, a gear coupling, and a braking mechanism, wherein the gear box is configured to engage with and rotate the circle relative to the drawbar around a circle axis, wherein the gear coupling includes a worm and a worm gear, wherein the braking mechanism and the motor shaft are positioned between a housing of the circle drive motor and the worm, wherein the braking mechanism is configured to lock the housing of the circle drive motor and the motor shaft together when the braking mechanism is engaged, wherein one or more portions of the circle drive motor or the motor shaft include one or more grooves or notches, wherein the braking mechanism includes one or more locking elements that are configured to engage with the one or more grooves or notches to secure one or more of the circle drive motor or the motor shaft in a locked configuration, and wherein the one or more locking elements include one or more of ratcheted fingers, springs, or teeth.

2. The grading machine of claim 1, wherein the braking mechanism is a hydraulically actuated brake.

3. The grading machine of claim 2, wherein the hydraulically actuated brake is coupled to the circle drive motor.

4. The grading machine of claim 1, wherein the circle drive motor includes an axis of rotation that is perpendicular to the circle axis.

5. The grading machine of claim 1, wherein the worm includes an axis of rotation that is parallel to the axis of rotation of the circle drive motor and perpendicular to the circle axis.

6. The grading machine of claim 1,
wherein the circle drive motor is a first circle drive motor,
wherein the gear box is a first gear box,
wherein the gear coupling is a first gear coupling,
wherein the braking mechanism is a first braking mechanism,
wherein the first gear box is configured to engage with a front portion of the circle to rotate the circle,
wherein the circle drive system further includes a second circle drive motor, a second gear box, a second gear coupling, and a second braking mechanism positioned between the second circle drive motor and the second gear coupling, and
wherein the second gear box is configured to engage with a rear portion of the circle and rotate the circle relative to the drawbar around the circle axis.

7. The grading machine of claim 6,
wherein the first braking mechanism and the second braking mechanism are configured to be automatically engaged during a grading operation, and
wherein the first braking mechanism and the second braking mechanism are configured to be automatically released during a blade positioning operation.

8. The grading machine of claim 6,
wherein the first braking mechanism and the second braking mechanism are configured to be engaged based on a user input or a manual operation on an actuator positioned in an operator cab, and
wherein the first braking mechanism and the second braking mechanism are configured to be released based on another user input or another manual operation on the actuator positioned in the operator cab.

9. The grading machine of claim 1, wherein the circle drive motor is a hydraulic motor.

10. The grading machine of claim 1, wherein the braking mechanism is further positioned between the housing of the circle drive motor and the motor shaft.

11. A circle drive system for a grading machine, comprising:
a circle drive motor that includes a motor shaft;
a gear box configured to engage with and rotate a circle;
a gear coupling including a worm and a worm gear coupling the circle drive motor to the gear box; and
a braking mechanism,
wherein the braking mechanism is positioned between a portion of the circle drive motor and the worm,
wherein the braking mechanism includes one or more locking elements that are configured to engage with one or more portions of the circle drive motor or the motor shaft, and
wherein the one or more locking elements include one or more of ratcheted fingers, springs, or teeth.

12. The circle drive system of claim 11, wherein the braking mechanism is configured to lock a rotation of at least a portion of the circle drive motor.

13. The circle drive system of claim 12,
wherein the braking mechanism is configured to engage with and lock the rotation of the motor shaft.

14. The circle drive system of claim 11,
wherein the circle drive motor is a first circle drive motor,
wherein the gear box is a first gear box,
wherein the gear coupling is a first gear coupling,
wherein the braking mechanism is a first braking mechanism, and
wherein the circle drive system further includes a second circle drive motor, a second gear box, a second gear coupling, and a second braking mechanism positioned between the second circle drive motor and the second gear coupling.

15. The circle drive system of claim 14, wherein the first gear box is configured to engage with a front portion of the circle to rotate the circle, and
wherein the second gear box is configured to engage with a rear portion of the circle to rotate the circle.

16. The circle drive system of claim 14,
wherein the first braking mechanism and the second braking mechanism are configured to be automatically engaged during a grading operation, and
wherein the first braking mechanism and the second braking mechanism are configured to be automatically released during a blade positioning operation.

17. The circle drive system of claim 14,
wherein the first braking mechanism and the second braking mechanism are configured to be engaged based on a user input or a manual operation on an actuator, and
wherein the first braking mechanism and the second braking mechanism are configured to be released based on another user input or another manual operation on the actuator.

18. A blade positioning system for a grading machine, comprising:
a circle coupled to a grading blade, wherein the circle is rotatable around a circle axis; and
a circle drive system, including:
a circle drive motor including a motor shaft and having a motor axis;
a gear coupling coupled to the circle drive motor and including a worm and a worm gear,
wherein the worm includes a worm axis parallel to the motor axis;
a gear box driven by the circle drive motor and the gear coupling, wherein the gear box includes a gear axis parallel to the circle axis, and wherein the gear box is configured to engage with and drive a rotation of the circle; and
a braking mechanism configured to selectively lock the motor shaft from rotating,
wherein the braking mechanism and the motor shaft are positioned between a portion of the circle drive motor and the worm,
wherein the braking mechanism includes one or more locking elements that are configured to engage with one or more portions of the motor shaft to lock the motor shaft from rotating, and
wherein the one or more locking elements include one or more of ratcheted fingers, springs, or teeth.

19. The blade positioning system of claim 18,
wherein the braking mechanism is configured to be automatically engaged during a grading operation, and
wherein the braking mechanism is configured to be automatically released during a blade positioning operation.

20. The blade positioning system of claim 18,
wherein the circle drive motor is a first circle drive motor,
wherein the gear coupling is a first gear coupling,
wherein the gear box is a first gear box,
wherein the braking mechanism is a first braking mechanism,
wherein the first gear box is configured to engage with a front portion of the circle to rotate the circle,
wherein the circle drive system further includes a second circle drive motor, a second gear coupling, a second gear box, and a second braking mechanism positioned between the second circle drive motor and the second gear coupling, and
wherein the second gear box is configured to engage with a rear portion of the circle and rotate the circle.

* * * * *